US010330433B2

(12) United States Patent
Gottzmann et al.

(10) Patent No.: US 10,330,433 B2
(45) Date of Patent: Jun. 25, 2019

(54) COMPOSITE HANDGUARD FOR A FIREARM AND MOUNTING/ATTACHMENT APPARATUS THEREFOR

(71) Applicant: Troy Industries, Inc., West Springfield, MA (US)

(72) Inventors: Andreas M. Gottzmann, Longmeadow, MA (US); Alexander M. Gottzmann, Longmeadow, MA (US)

(73) Assignee: TROY INDUSTRIES, INC., West Springfield, MA (US)

( * ) Notice: Subject to any disclaimer, the term of this patent is extended or adjusted under 35 U.S.C. 154(b) by 0 days.

(21) Appl. No.: 15/009,781

(22) Filed: Jan. 28, 2016

(65) Prior Publication Data

US 2017/0023329 A1 Jan. 26, 2017

Related U.S. Application Data

(63) Continuation-in-part of application No. 14/747,005, filed on Jun. 23, 2015, now abandoned.

(60) Provisional application No. 62/015,626, filed on Jun. 23, 2014.

(51) Int. Cl.

| | |
|---|---|
| ***F41C 23/16*** | (2006.01) |
| ***F41A 21/48*** | (2006.01) |
| ***F41C 23/18*** | (2006.01) |

(52) U.S. Cl.

CPC ..... *F41C 23/16* (2013.01); *F41A 21/48* (2013.01); *F41C 23/18* (2013.01)

(58) Field of Classification Search

CPC ..... F41C 23/16; F41A 21/48
USPC ..... 42/71.01
See application file for complete search history.

(56) References Cited

U.S. PATENT DOCUMENTS

| | | | | |
|---|---|---|---|---|
| 2,965,994 | A | 12/1960 | Sullivan | |
| 3,090,150 | A * | 5/1963 | Stoner | F41A 13/12 42/71.01 |
| 4,536,982 | A | 8/1985 | Bredbury et al. | |
| 4,663,875 | A | 5/1987 | Tatro | |
| 6,671,990 | B1 * | 1/2004 | Booth | F41C 23/16 42/75.01 |
| 7,216,451 | B1 * | 5/2007 | Troy | F41C 23/16 42/71.01 |
| 7,584,567 | B1 | 9/2009 | DeSomma et al. | |
| 7,802,392 | B2 | 9/2010 | Peterson et al. | |
| 8,028,460 | B2 | 10/2011 | Williams | |
| 8,037,633 | B1 | 10/2011 | Troy | |
| 8,141,289 | B2 * | 3/2012 | Gomez | F41C 23/16 42/90 |

(Continued)

*Primary Examiner* — Stephen Johnson
*Assistant Examiner* — Benjamin S Gomberg
(74) *Attorney, Agent, or Firm* — Grossman, Tucker, Perreault & Pfleger, PLLC

(57) ABSTRACT

An apparatus to couple a handguard to a firearm having a barrel nut, wherein the barrel nut includes a cylindrical portion and an outwardly protruding flange with a plurality of scalloped regions, the apparatus comprising at least one handguard mounting member, the handguard mounting member providing a collar configured to at least partially circumscribe the cylindrical portion of the barrel nut, and the least one handguard mounting member configured to fit in at least one of the scalloped regions of the plurality of scalloped regions of the barrel nut to inhibit rotation of the at least one handguard mounting member relative to the barrel nut.

18 Claims, 11 Drawing Sheets

(56) References Cited

U.S. PATENT DOCUMENTS

| | | | | |
|---|---|---|---|---|
| 8,276,303 | B2 | 10/2012 | Kapusta et al. | |
| 8,448,367 | B2 * | 5/2013 | Samson | F41A 13/12 42/75.02 |
| 8,464,457 | B2 * | 6/2013 | Troy | F41C 23/16 42/71.01 |
| 8,522,467 | B1 | 9/2013 | Christensen et al. | |
| 9,303,949 | B1 | 4/2016 | Oglesby | |
| 2005/0268513 | A1 | 12/2005 | Battaglia | |
| 2006/0207152 | A1 | 9/2006 | Lazor | |
| 2014/0305019 | A1 | 10/2014 | King, Jr. et al. | |
| 2015/0135576 | A1 * | 5/2015 | Wells | F41C 23/16 42/90 |
| 2015/0285585 | A1 | 10/2015 | Hewes et al. | |
| 2016/0298925 | A1 | 10/2016 | Gottzmann et al. | |

* cited by examiner

FIG. 7
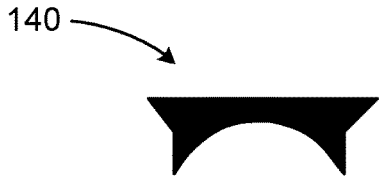
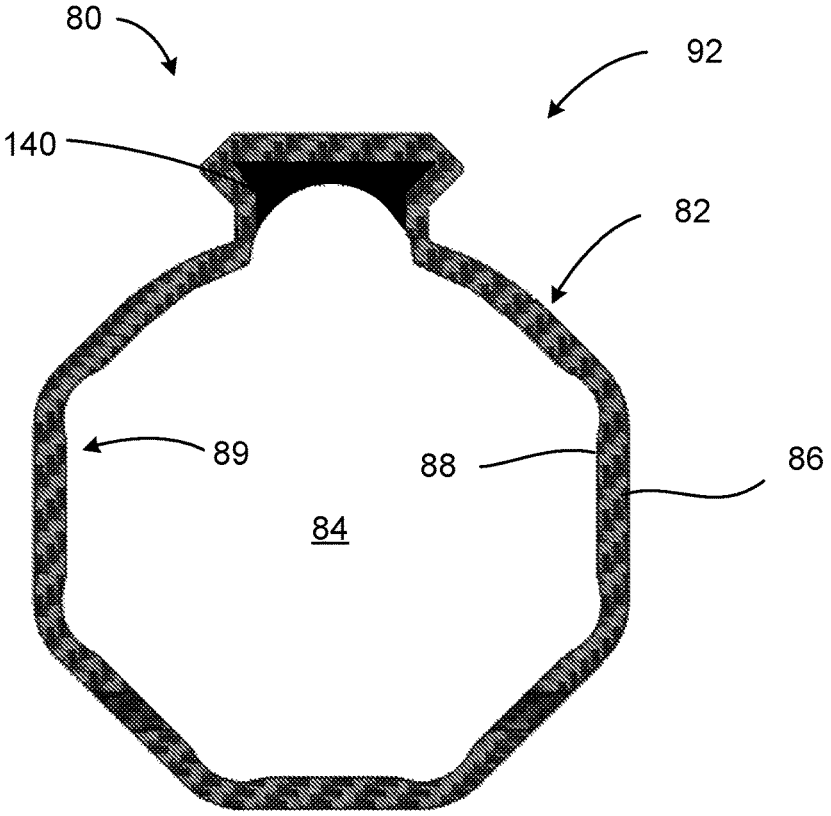
FIG. 8

COMPOSITE HANDGUARD FOR A FIREARM AND MOUNTING/ATTACHMENT APPARATUS THEREFOR

CROSS-REFERENCE TO RELATED APPLICATIONS

This application is a continuation-in-part of U.S. non-provisional application Ser. No. 14/747,005 filed Jun. 23, 2015, which claims the benefit of U.S. provisional application No. 62/015,626, filed Jun. 23, 2014, the entire content of each of which is incorporated herein by reference.

FIELD

The present disclosure relates to relates to firearms, and more particularly relates to a handguard for a firearm, as well as a mounting/attachment apparatus to mount and attach the handguard to the firearm.

BACKGROUND

Certain firearms, such as certain semi-automatic and automatic firearms in the family of AR-15/M16 firearms, may include a tubular handguard which surrounds at least a portion of the length of the barrel.

Among other functions, the handguard may protect the firearm operator's hand from a heated barrel after the firearm is fired, particularly by inhibiting the operator's hand from contacting the barrel directly and subsequently suffering a burn or other injury. The handguard may also protect the barrel and other parts of the firearm contained therein from being damaged during use of the firearm.

The handguard may be made of metal, particularly aluminum. However, in response to extreme use of the firearm, a metal handguard may be understood to heat-up due to the high thermal conductivity of the metal, and thus defeat the objective of protecting the firearm operator's hand from heat associated with the barrel after the firearm is fired.

In order to address the problems associated with the heating of metal handguards, injection molded thermoplastic polymer handguards have been developed. However, while addressing the problems associated with the heating of metal handguards, the injection molded thermoplastic polymer may not offer adequate strength or other physical properties, such as impact resistance or heat resistance.

In order to increase either the impact resistance and/or heat resistance of an injection molded thermoplastic polymer, fiber reinforcement may be added to the injection molded thermoplastic polymer to provide a fiber-reinforced thermoplastic handguard.

However, a fiber-reinforced thermoplastic polymer, while possibly offering an increase in impact resistance and heat resistance as compared to an unreinforced thermoplastic polymer, still may suffer from impact resistance and heat resistance limitations as the fiber length of injection molded fiber reinforced thermoplastic polymers is generally less than 10 mm, and more commonly less than about 3 mm, due to the screw of the injection molding machine tending to break the fibers as they are processed within the barrel. Furthermore, fiber loading levels may generally be limited to about 20-30% by weight.

Many handguards also require custom mounting, which requires modification of the firearm in order to install the handguard.

SUMMARY

The present disclosure provides plastic composite handguards, particularly formed with long fiber reinforced plastic composite for added strength (impact) and heat resistance.

The handguards may include an accessory mounting rail. The accessory mounting rail may include an inner elongated rail segment located beneath the fiber reinforced plastic composite which extends longitudinally along a length of the mounting rail.

The handguard may be mounted to the firearm using a handguard mounting member which overlies a barrel nut of the firearm.

FIGURES

The features of this disclosure, and the manner of attaining them, will become more apparent and better understood by reference to the following description of embodiments described herein taken in conjunction with the accompanying drawings, wherein:

FIG. 7 is a cross-sectional view of an elongated insert for another embodiment of the handguard of the firearm of FIG. 1 according to the present disclosure;

FIG. 8 is a cross-sectional view of another embodiment of the handguard of the firearm of FIG. 1 taken along line 4-4 of FIG. 1 including the insert of FIG. 7;

Figure 10:
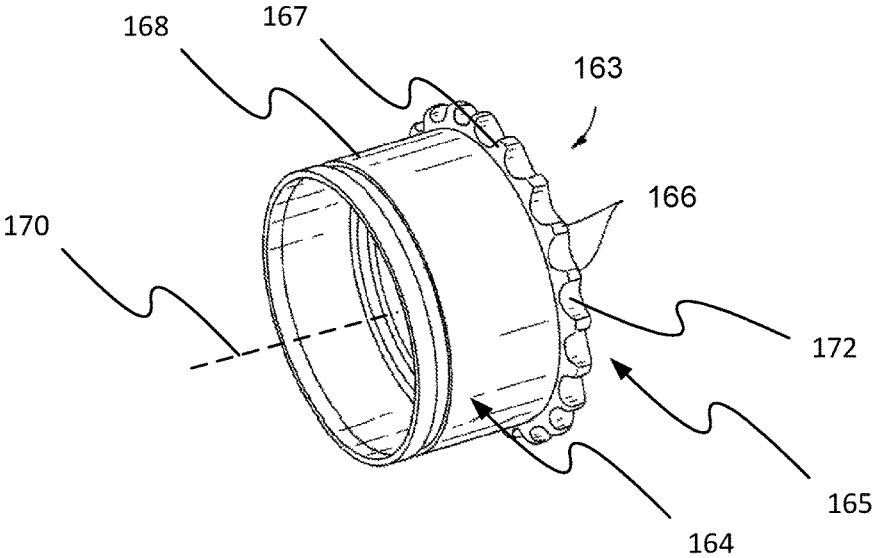
FIG. 10 (prior art)
FIG. 10 is a perspective view of a conventional barrel nut for an AR-15/M16 firearm according to the prior art.
Figure 11:
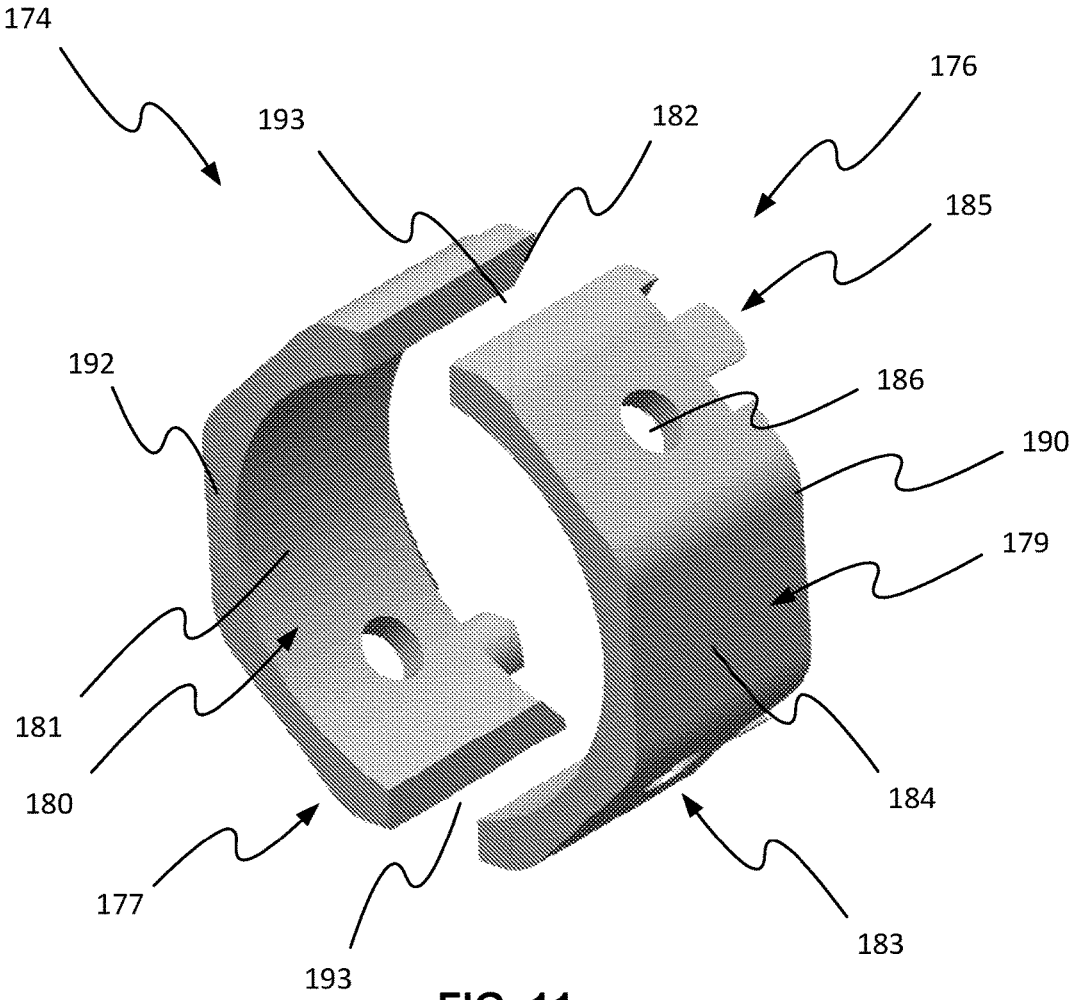
FIG. 11 is a perspective view of another embodiment of a handguard mounting/attachment apparatus which may be provided with or otherwise utilized with a handguard according to the present disclosure, which may comprise first and second mounting members.
Figure 12:
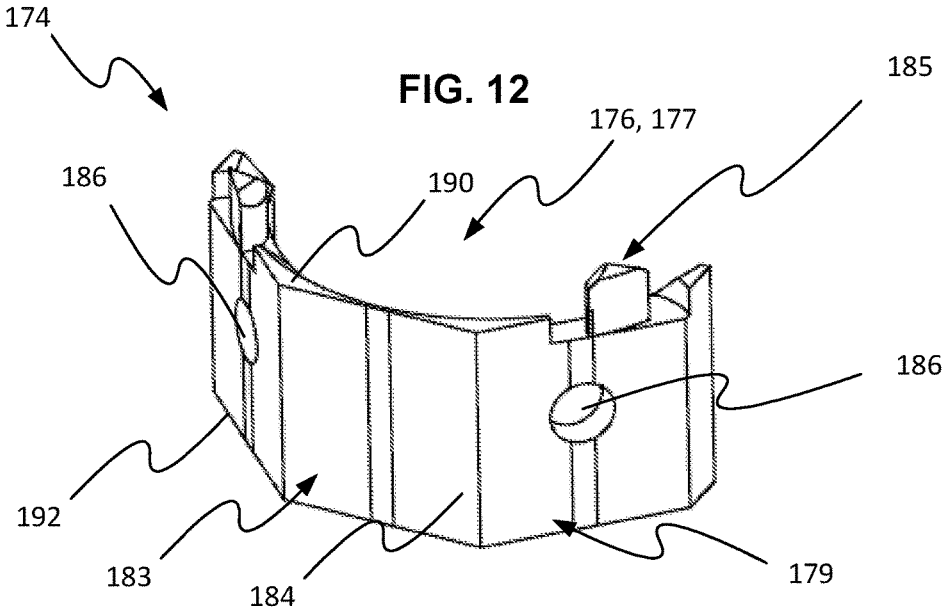
Figure 13:
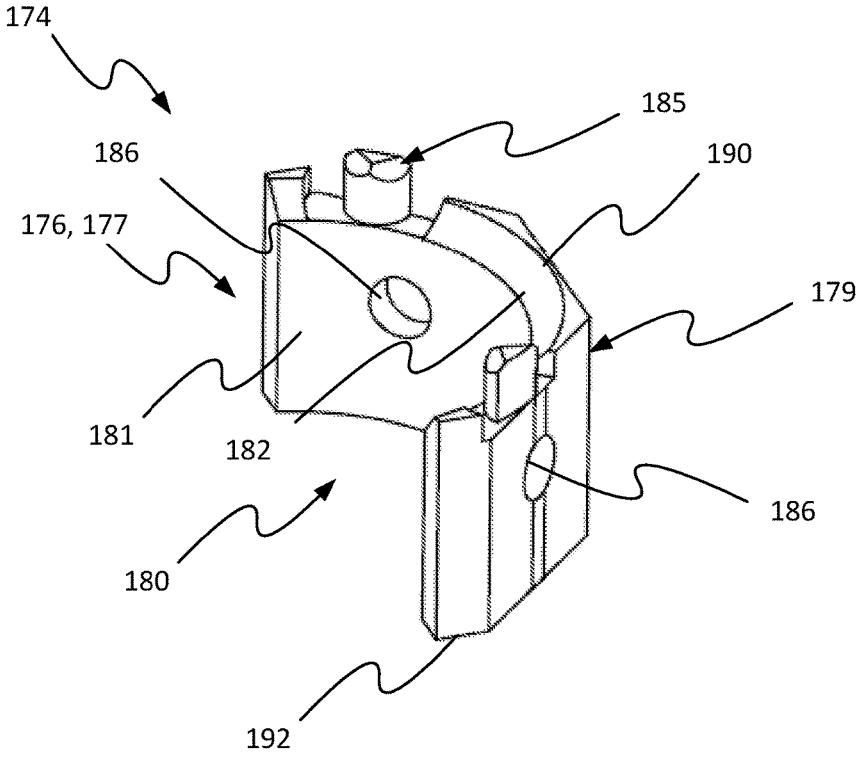
Figure 14:
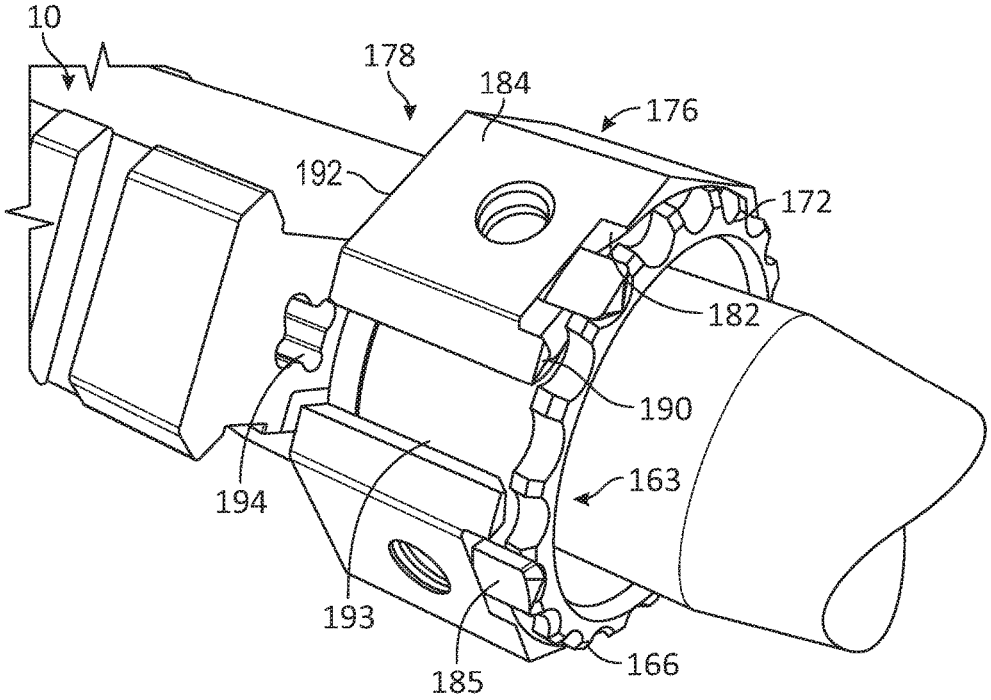
Figure 15:
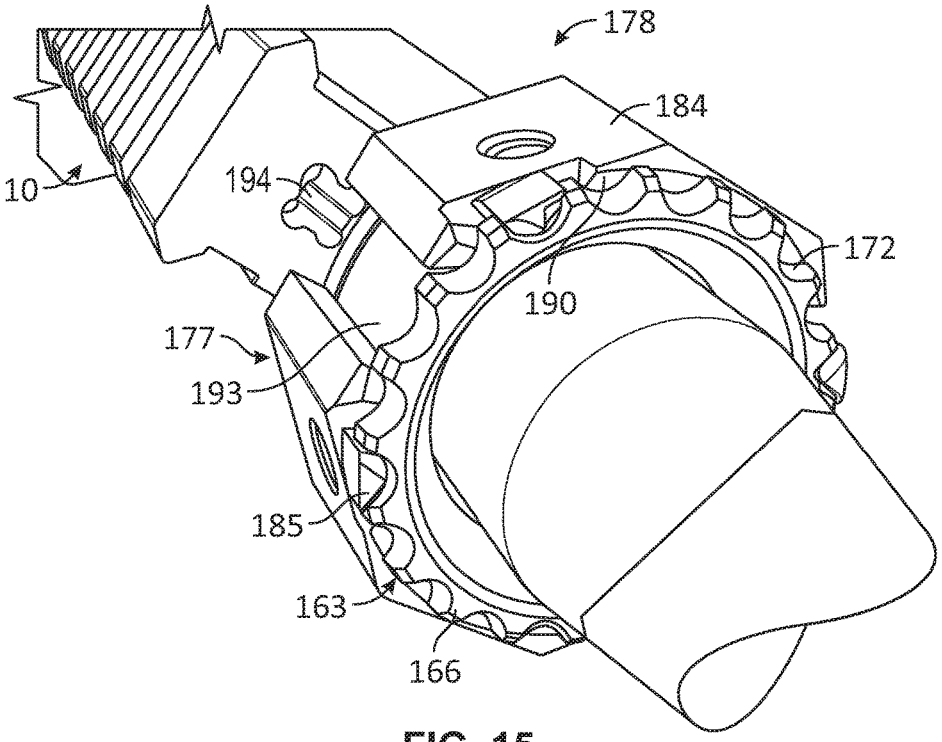
Figure 16:
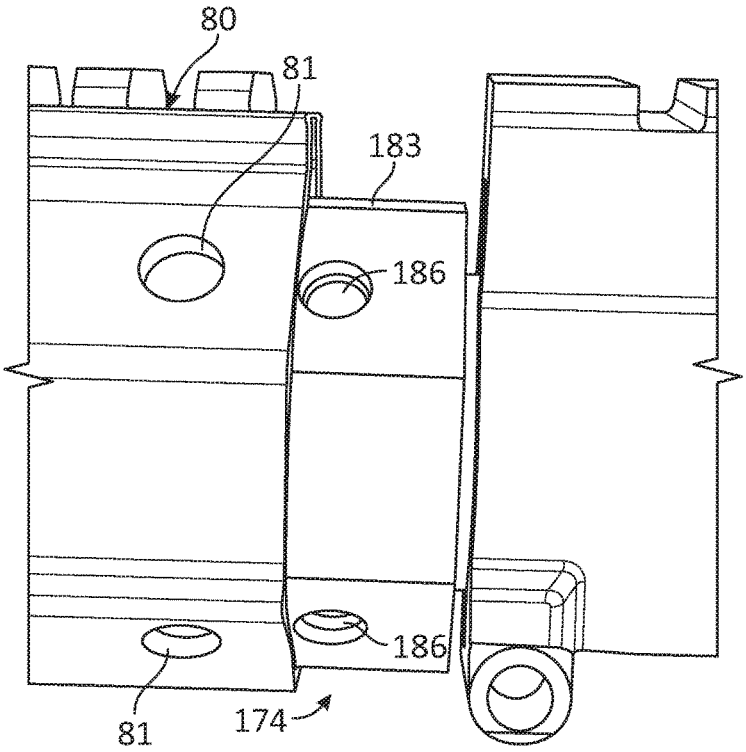
Figure 17:
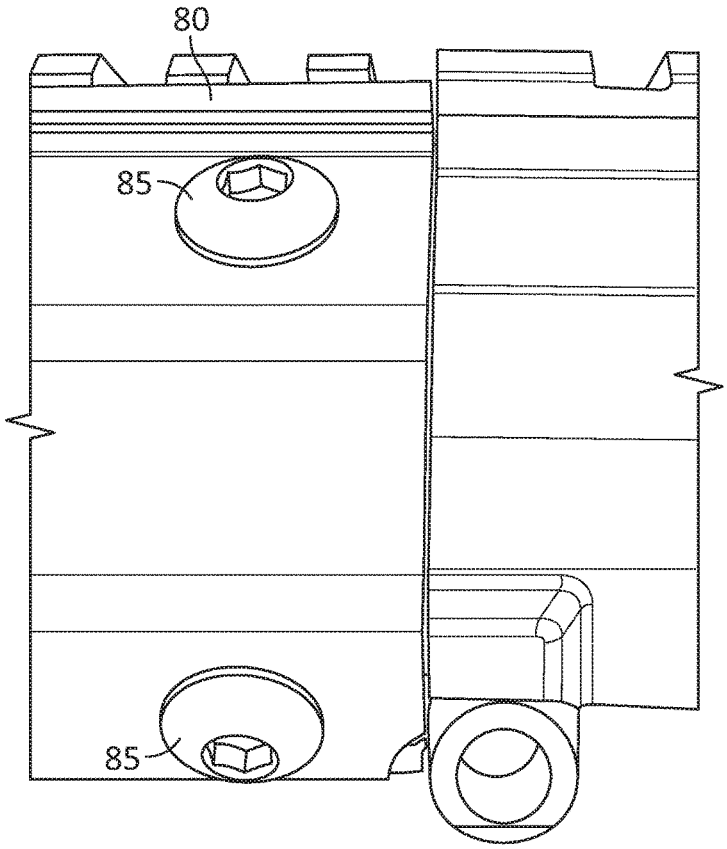
Figure 18:
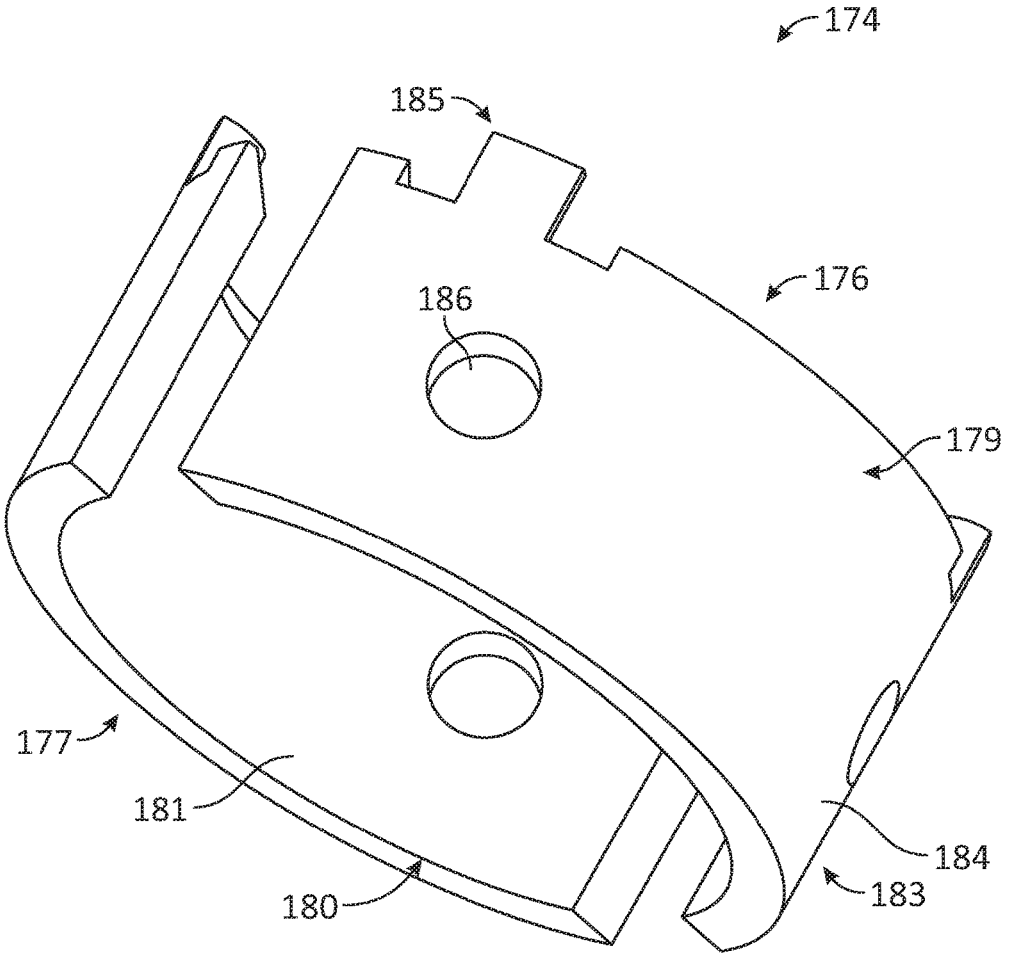

FIG. 12 a perspective view of a one of the mounting members of the handguard mounting/attachment apparatus of FIG. 11;

FIG. 13 another perspective view of a one of the mounting members of the handguard mounting/attachment apparatus of FIG. 11;

FIG. 14 is a perspective view of the handguard mounting/attachment apparatus of FIG. 11 coupled with the barrel nut of FIG. 10 on an AR-15/M16 firearm;

FIG. 15 is another perspective view of the handguard mounting/attachment apparatus of FIG. 11 coupled with the barrel nut of FIG. 10 on the AR-15/M16 firearm;

FIG. 16 is a side view of a handguard according to the present disclosure slideably and partially engaging over the handguard mounting/attachment apparatus of FIG. 11 and barrel nut of FIG. 10 on the AR-15/M16 firearm;

FIG. 17 is a side view of a handguard according to the present disclosure slideably and fully engaging over the handguard mounting/attachment apparatus of FIG. 11 and barrel nut of FIG. 10 on the AR-15/M16 firearm; and FIG. 18 is a perspective view of another embodiment of a handguard mounting/attachment apparatus which may be provided with or otherwise utilized with a handguard according to the present disclosure, which may comprise first and second mounting members.

DETAILED DESCRIPTION

It may be appreciated that the present disclosure is not limited in its application to the details of construction and the arrangement of components set forth in the following description or illustrated in the drawings. The invention(s) herein may be capable of other embodiments and of being practiced or being carried out in various ways. Also, it may be appreciated that the phraseology and terminology used herein is for the purpose of description and should not be regarded as limiting as such may be understood by one of skill in the art.

Figure 1:
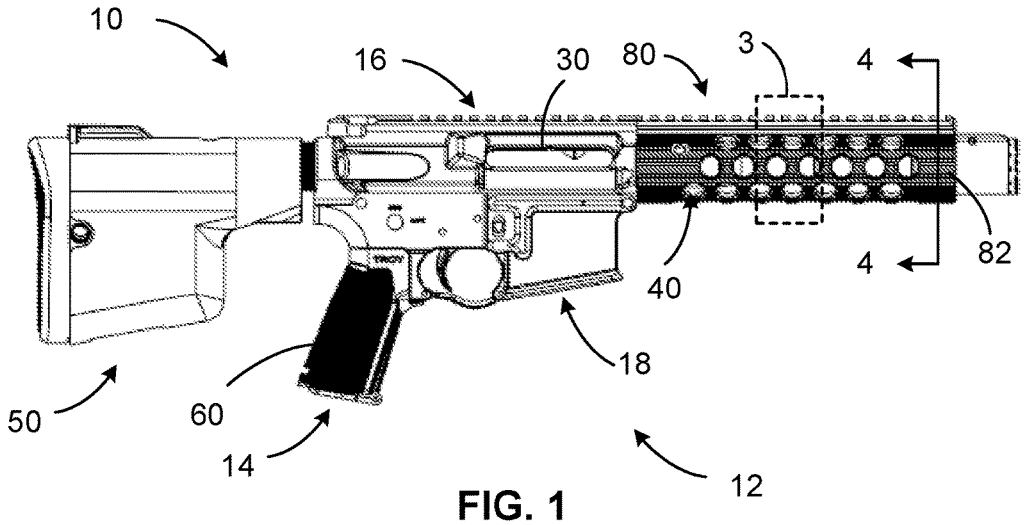
FIG. 1 is a side view of a firearm which includes a handguard and a mounting/attachment apparatus according to the present disclosure.
Figure 2:
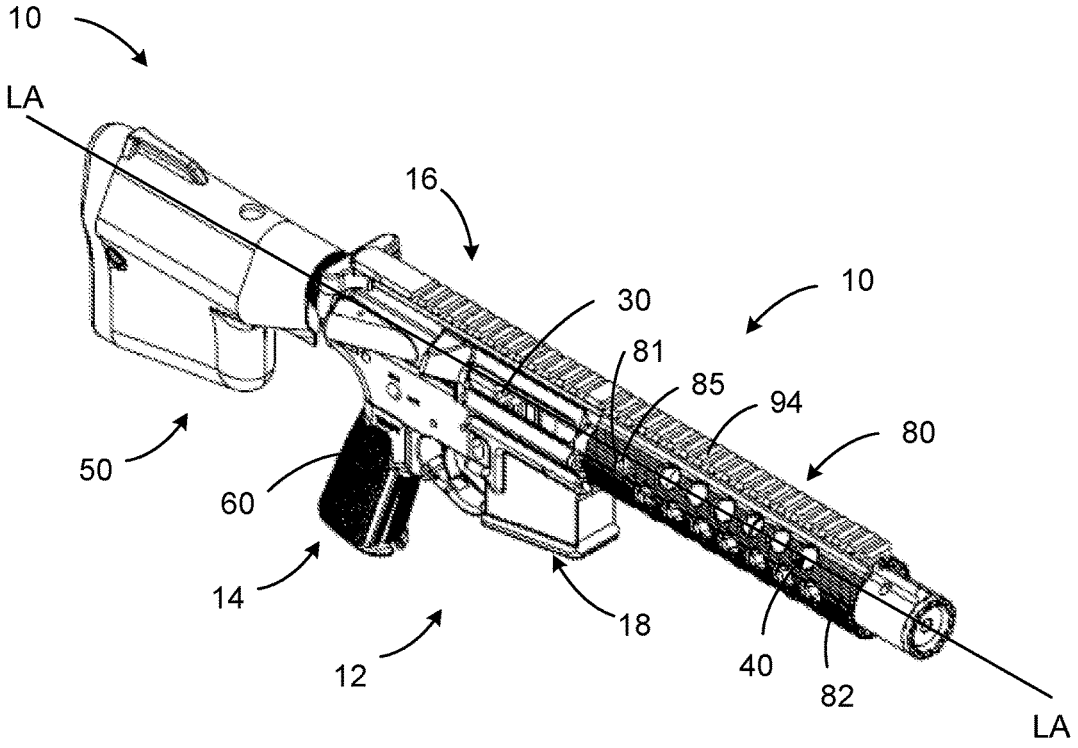
FIG. 2 is a front perspective view of the firearm of FIG. 1.

Referring now to FIGS. 1-2, there is shown a firearm 10 according to the present disclosure. As shown, the firearm 10 may comprise a gas-operated semi-automatic or full-automatic firearm. The gas operated system may be a direct gas impingement system, or a gas operated piston system. The direct gas impingement system directs hot propellant combustion gas from a fired cartridge directly to a bolt carrier to cycle the action of the firearm. More particularly, the gas pressure of the combustion gas pushes the bolt carrier rearward against the bias of a buffer spring, during which time the fired cartridge case is extracted from the chamber of the barrel and ejected from the firearm. As the gas pressure dissipates, the compressed buffer spring then decompresses and pushes the bolt carrier forward, during which time an unfired cartridge is removed from the magazine and loaded into the chamber of the barrel. In contrast to a direct gas impingement system, with a gas operated piston system, the gas forces a piston rod of a piston and the bolt carrier rearward to handle the extraction and ejection process, and thereafter the bolt carrier is forced forward by a decompression of the buffer spring to the closed position just as with direct impingement.

Even more particularly, firearm 10 may be a member of the family of AR-15/M16 firearms, which may include the AR-10, AR-15, M16, M16A1, M16A2, M16A3, M16A4, M4, M4A1, CAR-15, etc. Firearm 10 may also include a submachine gun, a compact assault rifle or a machine pistol. Firearm 10 may be configured to fire rifle cartridges (e.g. the 5.56×45 mm NATO military cartridge, 5.56/.223 Remington, 300 Blackout, 0.308 Win/7.62×51, 5.45×39, 7.62×39, 458 SOCOM, and 0.50 Beowulf) as well as pistol cartridges (9 mm). Firearm 10 may be categorized as a rifle, a carbine, a mid-length or a pistol, particularly depending on barrel length.

As shown, firearm 10 includes a receiver 12 comprising a lower receiver 14 and mating upper receiver 16. Upper receiver 16 includes bolt carrier 30 including a firing pin, as well as a cartridge loading and unloading mechanism. A barrel 40 is affixed to the front end of upper receiver 16 and a butt stock 50 is affixed to the rear end of lower receiver 14. A trigger portion of upper receiver 16 fits into an access opening in lower receiver 14 and is integrated with the internal mechanism of upper receiver 16 and lower receiver 14. A pistol grip 60 is attached to lower receiver 14. A detachable (removable) box magazine as known in the art (not shown) may be inserted into a magazine receptacle 18 having a downwardly oriented access opening in lower receiver 14 for feeding cartridges to the cartridge insertion and ejection mechanism within upper receiver 16. The detachable magazine is capable of being loaded and unloaded while detached from firearm 10, and holds the cartridges side-by-side in one or more columns/rows, which may be staggered. In certain embodiments, the detachable magazine may also comprise a drum magazine in which the cartridges are positioned and fed in an unwinding spiral.

Figure 3:
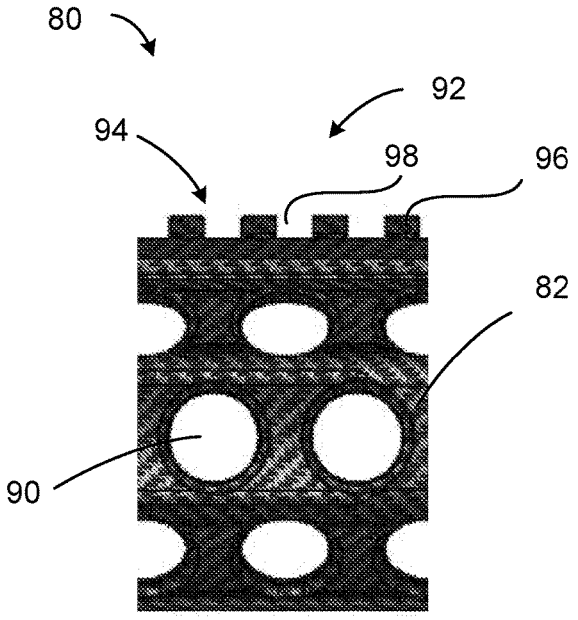
FIG. 3 is an enlarged side view of the portion of the handguard of the firearm of FIG. 1 bounded by rectangle 3.

A handguard 80 is affixed at the front end of upper receiver 16, either to the upper receiver 16 or the barrel 40. Handguard 80 includes an elongated tubular body 82. FIG. 3 shows an enlarged view of the portion of tubular body 82 bounded by the area of rectangle 3 of FIG. 1, while FIG. 4 shows a cross section of the tubular body 82 taken along line 4-4 of FIG. 1.

Figure 4:
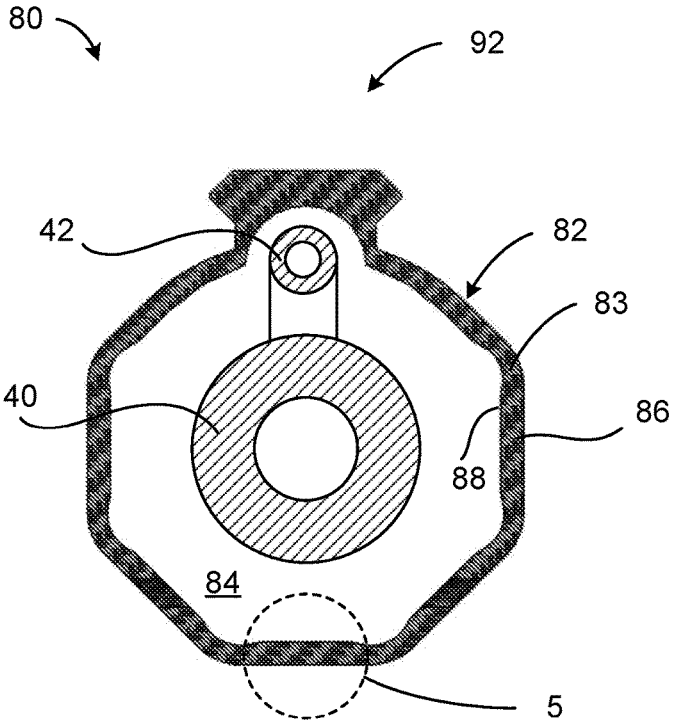
FIG. 4 is a cross-sectional view of the handguard of the firearm of FIG. 1 taken along line 4-4 of FIG. 1.

As shown by FIG. 4, the tubular body 82 may have a substantially octagonal (i.e. having 8 sides) shaped cross-section. It will of course be understood that the cross-sectional profile could be oval, square, rectangular, or any cylindrical configuration which is hollow so as to surround at least a portion of the barrel 40 of firearm 10 without coming in contact therewith along the length of the barrel 40 or the combustion gas return tube 42 that is surrounded. The length of tubular body 82 of handguard 80 may particularly be such that, when mounted on firearm 10, it extends from the front surface of the upper receiver 16 of the firearm 10 to a distance short of the end of the barrel 30 for easy and convenient gripping by the firearm operator and for protection of the operator's hand from the barrel 40. Handguard 80, and more particularly the tubular body 82, may also serve as a platform to mount accessories to the fore-end of the firearm 10, such as by providing one or more accessory mounting rails as discussed herein. As shown, the tubular body 82 of the handguard 80 may be provided by as a single piece tubular member.

As shown, tubular body 82 defines an elongated center passage 84 to contain the barrel 40, as well as certain other components (e.g. the combustion gas return tube or other accessories/features that may be incorporated at some future time) depending on the type of firearm 10. Tubular body 82 has an outer surface 86 and an inner surface 88, and may include a plurality of rows of apertures 90 formed therein, particularly to vent heat away from the barrel 40. While the apertures 90 are shown as having a circular shape, the apertures 90 may have any geometric shape including oval, ellipse, triangle, square, rhombus, diamond, rectangle, pentagon, hexagon, heptagon, octagon, etc. The apertures 90 may be formed in the tubular body 82 after the handguard 80 is molded as discussed in greater detail below.

The top side 92 of the handguard 80, and the tubular body 82, may include an elongated accessory (mounting) rail 94, which provides a mounting platform for accessories (e.g., scope). As shown by FIG. 4, elongated rail 94 has a T-shaped cross-sectional profile (transverse to the longitudinal axis LA of the handguard 80). Elongated rail 94 may more particularly be a Weaver rail or a Picatinny rail, comprising a plurality of alternating equally spaced parallel ribs 96 and slots 98 extending transverse to the longitudinal axis LA of the handguard 80.

Figure 5:
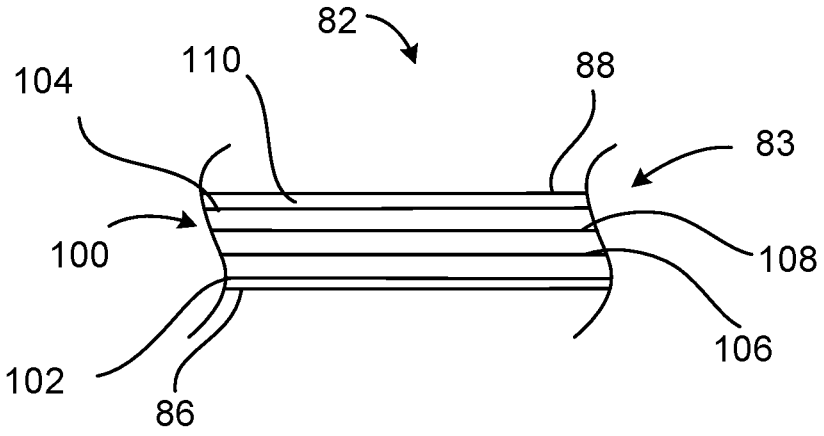
FIG. 5 is an enlarged cross-sectional view of the portion of the handguard of FIG. 4 bounded by circle 5.

Referring now to FIG. 5, handguard 80, and more particularly wall 83 forming tubular body 82, may be formed of a composite material comprising a plurality of constituent components. More particularly, the composite material may be a fiber reinforced plastic composite material, in which a reinforcement structure 100 in fiber form is embedded in a matrix (binder) composition 110 which comprises at least one polymer. The reinforcement structure 100 may also be referred to as the discontinuous phase while the matrix composition 110 may be referred to as the continuous phase. The composite material of the present disclosure may provide a handguard 80 formed of a thermal (non-conductive) insulator which provides high heat resistance, high impact strength and protects the operator's hand from the heat of the barrel 40, as well as inhibits the rail 94 as disclosed herein from heating, possibly adversely effecting the operation of any accessories mounted thereon.

The matrix composition 110 may be a thermoset matrix composition formed of at least one thermoset polymer. Exemplary thermoset polymers may include polyester, epoxy, vinyl ester, methyl methacrylate and phenolic. The matrix composition 110 may be optically opaque, translucent or transparent. When optically translucent or transparent, the reinforcement structure 100 may be visible from outer surface 86 or inner surface 88. The matrix composition 110 may also include a colorant, which may be in the form of a pigment or a dye, which colors the matrix composition 110. The matrix composition may be colored with a camouflage color, such as a brown (earth) tone or a tan (sand) tone or a green (vegetation) tone.

The reinforcement structure 100 may particularly comprise at least one pre-manufactured fiber reinforcement layer 102, which is embedded in the matrix composition 110. A pre-manufactured fiber reinforcement layer may be understood as a fiber reinforcement layer which is first formed into a reinforcement layer separate from the matrix 110. Such would not include, for example, loose, random fibers which are packaged as such.

More particularly, the at least one fiber reinforcement layer 102 may comprise a plurality of fiber reinforcement layers 102, 104, 106 and 108. As shown by FIG. 5, fiber reinforcement layer 102 is shown to be an outer reinforcement layer, reinforcement layer 104 is shown to be an inner reinforcement layer and reinforcement layers 106, 108 are shown to be intermediate reinforcement layers between outer reinforcement layer 102 and inner reinforcement layer 104.

Any one or all of the fiber reinforcement layers 102, 104, 106 and 108 may be provided by a tubular fiber reinforcement member, which is particularly provided without a terminating edge or a seam extending in the longitudinal direction of the tubular reinforcement member (which may be understood to be in the same as the longitudinal axis LA of the handguard 80). More particularly, any one or all of the reinforcement layers 102, 104, 106 and 108 may be provided by a tubular braided and/or woven fabric sleeve. For example, any or all of the fiber reinforcement layers 102, 104, 106 and 108 may comprise a braided fiber sleeve where the fibers (continuous) are arranged (woven) in a multi-directional (biaxial) braid such that the braided fiber bundles (braid yarns or strands) are arranged off-axis, i.e. at an angle of +/−45 degrees) relative to the longitudinal axis LA of the tubular sleeve. Stated another way, the fibers are not arranged parallel to a longitudinal axis LA of the tubular body 82. In such a manner, the fiber orientation may provide for balanced control of torsional and longitudinal loads placed on the handguard 80. Also, while the tubular braided sleeve may be manufactured with the fiber bundles at +/−45 degrees, the actual orientation in the molded tubular body 82 may be broader (due to stretching or other shaping of the tubular braided sleeve), such as within a range of in a range of +/−30 degrees to +/−60 degrees.

Any one or all of the reinforcement layers 102, 104, 106 and 108 may also comprise a woven fiber sleeve where the fibers (continuous) are arranged (woven) such that the fiber bundles (braid yarns or strands) are arranged multi-directionally, particularly longitudinally (0 degrees) and transversely (90 degrees), relative to the longitudinal axis LA of the tubular sleeve. Stated another way, the fibers are arranged parallel and perpendicular to a longitudinal axis LA of the tubular body 82.

Any one or all of the fiber reinforcement layers 102, 104, 106 and 108 may also be provided by a fiber mat, which may be a continuous strand mat or a chopped strand mat.

While it may be preferred that each of the fiber reinforcement layers 102, 104, 106 and 108 are provided by independent (discrete) members, fiber reinforcement layers 102, 104, 106 and 108 may also formed by a single mat which is wrapped in a coil to provide the fiber reinforcement layers 102, 104, 106 and 108 is overlying/underlying relationship.

Any one or all of the reinforcement layers 102, 104, 106 and 108 may be made of glass fibers, carbon fibers or a combination thereof. In a particular embodiment, reinforcement layers 104, 106 and 108 may be made of carbon fiber, while reinforcement layer 102 is made of glass fiber. In another embodiment, reinforcement layers 102, 104 and 108 may be made of carbon fiber, while reinforcement layer 106 made of glass fiber. The weight/area and the diameter of the layers 102, 104, 106, 108 may vary depending on the particular application of the handguard 80 and the type of firearm 10.

With regards to fiber loading, the tubular body 82, may have a fiber content in a range of 30% to 60% by weight of the tubular body 82, and more particularly have a fiber content in a range of 35% to 55% by weight of the tubular body 82. The fibers may comprise 80-95% by weight carbon fibers and 5%-20% by weight glass fibers. The tubular body may have a thickness in a range of 0.5 mm to 10 mm, and more particularly have a thickness in a range of 2 mm to 5 mm.

The handguard 80, and more particularly the tubular body 82, may be formed by a closed mold (i.e. two-sided) molding process, such as resin infusion molding process where the matrix composition (e.g. polymer resin) is introduced into a mold containing the preplaced/preloaded reinforcement structure 100. More particularly, the resin infusion molding process may be a resin transfer molding process, which may be vacuum (i.e. less than atmospheric pressure) or pressure (i.e. greater than atmospheric pressure) assisted, to obtain a tubular body 82 with low void content and high fiber loading.

As part of the process, a mold may be provided which has at least one molding cavity to form the tubular body 82, with the molding cavity being defined by opposing mold halves which may be referred to as the core half and cavity half. The molding process may begin by opening the mold and placing the inner reinforcement layer 104 over an elongated core half of a mold, which may be referred to as the mandrel. The intermediate layer 108 may then be placed over the inner layer 104, followed by intermediate layer 106 and the outer layer 102 placed over the intermediate layer 106 to form a four layer reinforcement structure 100. The mold may then be closed and clamped.

In alternative embodiments the reinforcement layers 102, 104, 106 and 108 may be formed to a preformed shape of the tubular body 82 before being placed in the mold, such as being formed over a performing mandrel and then sprayed with a stiffening agent such as starch. The reinforcement layers 102, 104, 106 and 108 may then all be introduced to the molding cavity simultaneously.

The matrix composition 110 may then introduced into the molding cavity (e.g. pumped in under pressure greater than gravity), such as while in the form of a catalyzed low viscosity polymer resin. The matrix composition 110 flows through the molding cavity and the interstices of the reinforcement layers 102, 104, 106 and 108 while displacing air from the molding cavity. Air may be displaced from the molding cavity through one or more molding cavity vents formed in the mold, or a vacuum may be drawn on the molding cavity to remove air from the molding cavity as well as assist helping the matrix composition 110 flow through the molding cavity and reinforcement layers 102, 104, 106 and 108 located therein.

After the matrix composition 110 has filled the mold and undergone a suitable cure time, the mold may be opened and the handguard 80 comprising the tubular body 82 removed from the mold. The tubular body 82 may then be trimmed and apertures 90 formed (cut) therein. Alternatively the apertures 90 may be formed therein during molding.

As an alternative to resin transfer molding, other resin infusion molding processes which may be used to manufacture the handguard 80 of the present disclosure may include structural reaction injection molding, which may particularly make use of a thermoset polymer such as a polyurethane which is processed through a reaction injection molding mixhead.

Another closed mold (i.e. two-sided) molding process which may be used to produce handguard 80, particularly tubular body 82, may be compression prepreg process in which a reinforcement structure is saturated with a matrix composition 110 (a/k/a pre-impregnation), which is then compression molded with heat and pressure to form the molded article.

In the foregoing embodiment of the handguard 80, the ribs 96 and slots 98 forming the elongated rail 94 may be formed in the tubular body 82 during molding. Alternatively, the ribs 96 and slots 98 may be formed after molding the tubular body 82 by milling otherwise cutting the slots 98 into the tubular body 82, thereby forming the ribs there between.

Figure 6:
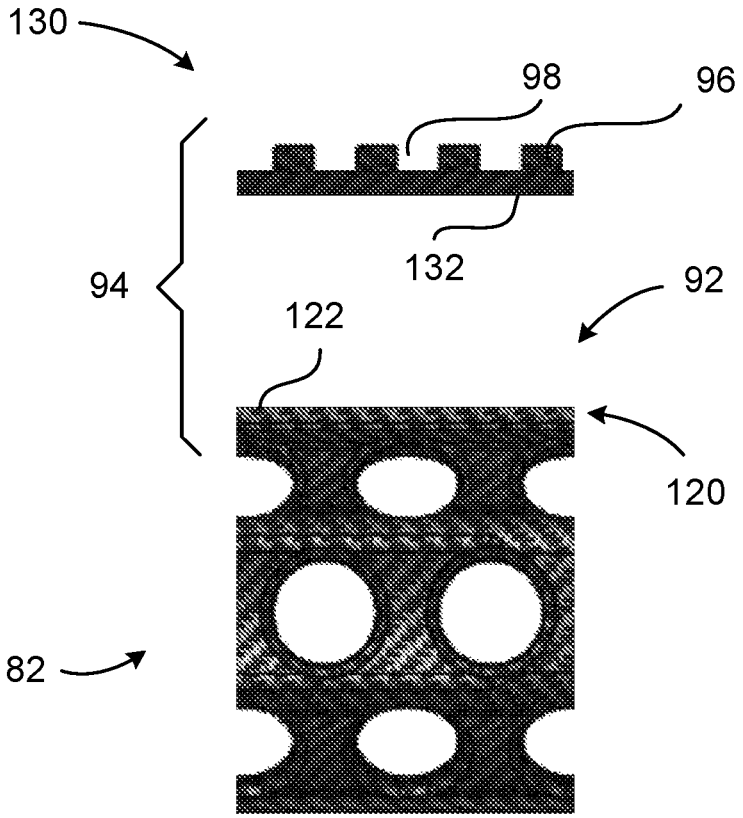
FIG. 6 is an enlarged side view of an another embodiment of the handguard of the firearm of FIG. 1 according to the present disclosure.

In another embodiment of the handguard 80 of the present disclosure, as shown in FIG. 6, a lower elongated rail segment 120 may be formed by the tubular body 82 which has a planar upper surface 122, and an upper elongated rail segment 130 may be formed separately from the tubular body 80 (i.e. preformed before manufacture of the tubular body 80), with the separately formed upper elongated rail segment 130 having a planar lower surface 132, as well as preformed ribs 96 and slots 98. The separately formed upper elongated rail segment 130 may be formed of metal (e.g. aluminum, steel, titanium), or a plastic (e.g. a composite as disclosed herein, or injection molded from a thermoplastic composition).

The planar lower surface 132 of the upper elongated rail segment 130 may be coupled to the planar upper surface 122 of the lower elongated rail segment 120 particularly by adhesive bonding with a separate bonding agent located there between. Alternatively, adhesive bonding the upper elongated rail segment 130 to the lower elongated rail segment 120 may be accomplished using the matrix composition 110.

Such may be accomplished by placing the upper elongated rail segment 130 in the forming mold for the tubular body 82, such as by positioning the upper elongated rail segment 130 on the cavity half of the mold, prior to introducing the matrix composition 110. Thereafter, when the matrix composition 110 is introduced into the molding cavity and the lower elongated rail segment 120/tubular body 82 is formed, the upper elongated rail segment 130 becomes a molded-in insert, which may also be referred to as inserted molded, during molding of the tubular body 82 which is bonded directly to the matrix composition 110 during molding. Alternatively, such may also be accomplished after tubular body 82 and the lower elongated rail segment 120 are formed by removing the tubular body 82 from the mold before the matrix composition 110 of the tubular body 82 has reach full cure, in which case the upper elongated rail segment 130 may be pressed onto the lower elongated rail segment 120 and bonded thereto while the matrix composition 110 of the tubular body 82 is still curing.

Alternatively, the separately formed upper elongated rail segment 130 may be mechanically coupled, rather than adhesively coupled, to the lower elongated rail segment 120 with a detachable mechanical fastener (e.g. a threaded fastener such as a screw) or a non-detachable mechanical fastener (e.g. a rivet).

In another embodiment of the handguard 80 of the present disclosure, as shown in FIG. 7, elongated rail 94 may include an inner elongated rail segment 140 which, similar to upper elongated rail segment 130, may be separately formed from the tubular body 80 (i.e. preformed before manufacture of the tubular body 80). The separately formed inner elongated rail segment 140 may be formed of metal (e.g. aluminum, steel, titanium), or a plastic (e.g. profile extruded from a thermoplastic composition).

The inner elongated rail segment 140 may be used to eliminate any need for a separately formed upper elongated rail segment 130, as will become more evident from the disclosure herein. Similar to the first embodiment of the disclosure, the ribs 96 and slots 98 forming the elongated rail 94 may be formed in the tubular body 82 during molding without need for the separately formed upper elongated rail segment 130. Alternatively, the ribs 96 and slots 98 may be formed after molding the tubular body 82 by milling otherwise cutting the slots 98 into the tubular body 82, thereby forming the ribs there between. However, it should be recognized that the present disclosure does not preclude the upper elongated rail segment 130 from being used in conjunction with the preformed inner elongated rail segment 140. It should be understood that when the rail 94 is formed of a lower elongated rail segment 120 and a separate molded-in or attached upper elongated rail segment 130, the inner elongated rail segment 140 will be part of the lower elongated rail segment 120.

Referring briefly to FIG. 4, as shown the elongated rail 94 may have a thicker cross-sectional profile, to increase stiffness, than the remainder of the tubular body 82 of the handguard 80. As a result, depending on the loft and weight of the reinforcement structure, the reinforcement structure 100 may be further from the outer surface 86 of the rail 94 than for the remaining thinner portion of the tubular body 82, resulting in an outer portion of the rail thickness being formed predominately of the matrix composition 110 with little or no reinforcement structure 100.

In order to overcome the foregoing difficulty and geometrical challenges of the used materials, inner elongated rail segment 140 may be placed in the mold, such as by positioning the inner elongated rail segment 140 on the core half of the mold, prior to introducing the reinforcement structure 100. This will, in effect, decrease the thickness of the molding cavity used to form rail 94. Thereafter, when the reinforcement structure 100 is placed on the core half of the mold, the reinforcement structure 100 will overlie the inner elongated rail segment 140, which will force the reinforcement structure 100 closer to the outer surface 86 of the handguard 80. Thereafter, when the matrix composition 110 is introduced into the molding cavity and the tubular body 82 is formed, the inner elongated rail segment 140 becomes a molded-in insert during molding of the tubular body 82 which is bonded directly to the matrix composition 110 during molding. In addition to the inner elongated rail segment 140 positioning the reinforcement structure 100 closer to the outer surface 86 of the handguard 80, in such fashion the inner elongated rail segment 140 will be enclosed and protected towards the inside of the rail 94 by the reinforcement structure 100, as well as increase the stiffness of the rail 94.

Figure 9:
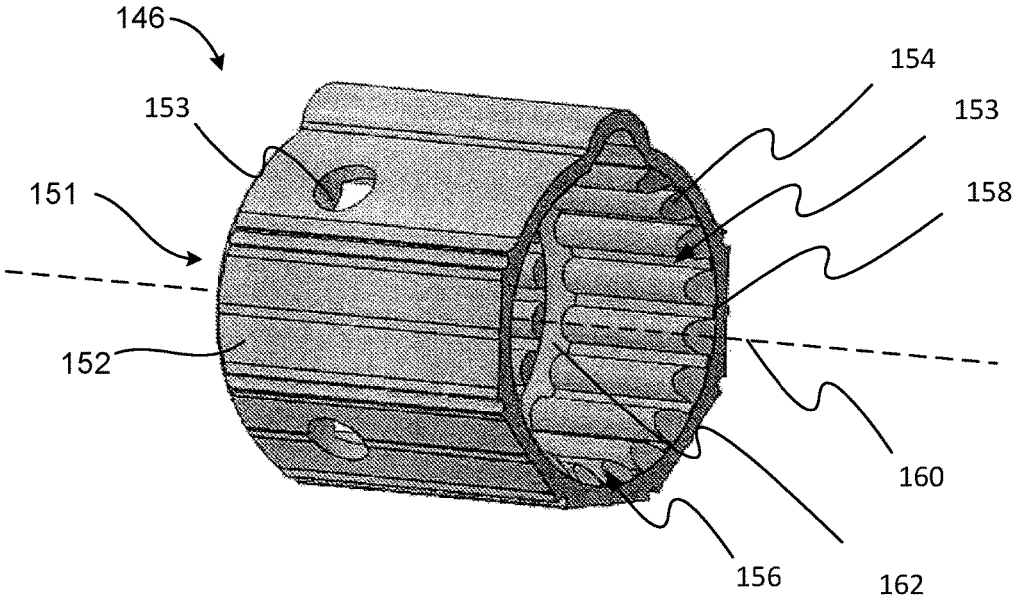
FIG. 9 is a perspective view of a handguard mounting/attachment apparatus which may be provided with or otherwise utilized with a handguard according to the present disclosure, particularly to mount and attach the handguard to the firearm.

In another embodiment of the handguard 80 of the present disclosure, as shown in FIG. 9, the handguard 80 may include mounting/attachment apparatus 146 configured to mount and attach the handguard 80 to firearm 10, particularly between the upper receiver 16 and the barrel 40 of firearm 10 via a barrel nut 163 as shown in FIG. 10. The mounting/attachment apparatus 146 may be formed of metal (e.g. aluminum, steel, titanium), or a plastic (e.g. a thermoset composite as disclosed herein, or injection molded from a thermoplastic composition). The mounting/attachment apparatus 146 and the handguard 80 may attach to the firearm 10 in a manner as disclosed in U.S. Pat. No. 8,037,633 entitled "Handguard System For Firearms" and/or U.S. Pat. No. 8,464,457 entitled "Firearm Handguard System", both assigned to the assignee of the present disclosure and both hereby incorporated by reference in their entirety.

As shown, mounting/attachment apparatus 146 may have an outer profile 152 (sides/surfaces) which substantially conforms or matches to the inner profile 89 (FIG. 8) of the tubular body 82. The mounting/attachment apparatus 146 may be coupled to the handguard 80 by being located within the elongated center passage 84 and interference (press-fit) against tubular body 82. Alternatively, the outer profile 152 of the mounting/attachment apparatus 146 and/or the inner profile 89 of the tubular body 82 may be coated with a bonding agent to form an adhesive bond therebetween. Alternatively, adhesive bonding the mounting/attachment apparatus 146 to the tubular body 82 of the handguard 80 may be accomplished using the matrix composition 110.

Such may be accomplished by placing the mounting/attachment apparatus 146 in the forming mold for the tubular body 82, such as by positioning the mounting/attachment apparatus 146 on the core half of the mold, prior to introducing the matrix composition 110. Thereafter, when the matrix composition 110 is introduced into the molding cavity and the tubular body 82 is formed, the mounting/attachment apparatus 146 becomes a molded-in insert during molding of the tubular body 82 which is bonded directly to the matrix composition 110 during molding. Alternatively, adhesive bonding the mounting/attachment apparatus 146 to the tubular body 82 of the handguard 80 may be accomplished using the matrix composition 110 as a coating which is applied to the tubular body 82 after molding, which may be brushed on. The mounting/attachment apparatus 146 may then be placed in overlying relationship to the coating and held with pressure thereto until the matrix composition 110 has suitably cured.

The mounting/attachment apparatus 146 may comprise a one-piece tubular mounting member 151 with a longitudinal passage 150 having an inner profile 156 (sides/surfaces) which includes a plurality of longitudinally oriented, semicircular ribs 154. The ribs 154 may be spaced such that a longitudinally oriented groove 158 is formed between each pair of adjacent ribs 154. As shown, the ribs 154 and grooves 158 may extend longitudinally, and more particularly substantially parallel (e.g. plus or minus 5 degrees) to a longitudinal axis 160 of the mounting/attachment apparatus 146, which may be the same as the longitudinal axis LA of the handguard 80.

The ribs 154 may extend continuously for the full (longitudinal) length of the mounting/attachment apparatus 146. However, in some embodiments, a circular (transverse) raceway 162 may circumscribe the inner profile 156 of the mounting/attachment apparatus 146. The raceway 162 may be understood to be located between adjacent rib segments, and, as such, cause the ribs 154 to extend non-continuously along the inner profile 156 of the mounting/attachment apparatus 146.

FIG. 10 shows the configuration of a conventional barrel nut 163 that, in operation, couples to the firearm 10. The barrel nut 163 comprises a main cylindrical (annular) internally threaded body portion 164, and an outwardly protruding (transverse), circular, scalloped lip/flange 165 having a plurality of equally sized and spaced tines 166 extending radially and circumferentially around the cylindrical body 164. The tines 166 are substantially perpendicular to a longitudinal axis 170 of the barrel nut 163, which may be the same as the longitudinal axis LA of the handguard 80. The tines 166 are spaced such that a plurality of equally sized and spaced scalloped regions 172 are formed between adjacent tines 166.

The shape of the inner profile 156 of the mounting/attachment apparatus 146 corresponds to the shape of the outer profile of the scalloped lip/flange 165 of the barrel nut 163 to allow the inner profile 156 of the mounting/attachment apparatus 146 to slideably engage the profile of the scalloped lip/flange 165 of the barrel nut 163.

More specifically, the grooves 158 of the mounting/attachment apparatus 146 slideably engage with the tines 166 of the barrel nut 163, while the ribs 154 of the mounting/attachment apparatus 146 slideably engage with the scalloped regions 172 of the barrel nut 163. When the mounting/attachment apparatus 146 slideably engages with the barrel nut 163 along the longitudinal axis 160/170, the barrel nut 163 inhibits the mounting/attachment apparatus 146 from rotating about longitudinal axis 160/170. However, in embodiments including the raceway 162, when the tines 166 of the barrel nut 163 enter the raceway 162 the mounting/attachment apparatus 146 may be rotated about longitudinal axis 160/170.

For example, the mounting/attachment apparatus 146 may be rotated as necessary for the tines 166 align with the ribs 154, which will prevent longitudinal movement of the mounting/attachment apparatus 146/handguard 80 along longitudinal axis 160/170, as well as align mounting apertures 81 (FIG. 1) of the handguard 80 with mounting (threaded) apertures 153 (FIG. 9) of the mounting/attachment apparatus 146.

Thereafter mounting and attachment of the handguard 80 may be completed by inserting a mechanical (threaded) fastener 85 (FIG. 1) through an aperture 81 in the handguard 80 which aligns with one of the mounting apertures 153 (FIG. 9) in the mounting/attachment apparatus 146, and threading the mechanical (threaded) fastener 85 into threaded mounting aperture 153.

In some embodiments, a mounting/attachment apparatus according to the present disclosure may be coupled to firearm 10 prior to coupling the handguard 80 to firearm 10. For example referring now to FIG. 11, there is shown a mounting/attachment apparatus 174 which may be coupled to firearm 10 prior to coupling the handguard 80 to firearm 10.

As shown in FIGS. 11-13, mounting/attachment apparatus 174 may comprise at least one member or may be comprised of two or more members. For example, the mounting/attachment apparatus 174 may include a first mounting member 176 and a second mounting member 177. The first mounting member 176 and the second mounting member 177 may have different shapes and/or sizes. However, as shown with the present embodiment, the first mounting member 176 may be the same shape as to match (or be identical to) the second mounting member 177 in size and shape. Furthermore, any general discussion of the mounting/attachment apparatus 174 will encompass all embodiments of the mounting/attachment apparatus 174 including those embodiments having at least the first mounting member 176 and the second mounting member 177.

In operation, mounting members 176, 177 form a collar 178 (see FIGS. 14 and 15) which surrounds (overlies) the barrel nut 163. More particularly, mounting members 176, 177 each comprise a first, or collar, region 179, which surrounds (overlies) the cylindrical body portion 164 of barrel nut 163, as well as a rearward portion of the scalloped lip/flange 165, including the tines 166. First (collar) region includes an inner profile/side 180 and an outer profile/side 183. The inner profile/side 180 and the outer profile/side 183 may take the same or different shapes (e.g., cylindrical, square, hexagonal, octagonal, etc. . . . ). For example, As shown the inner profile/side 180 may comprise a cylindrically shaped surface 181 and the outer profile/side 183 may have a plurality of adjacent planar surfaces 184, arranged at an acute angle relative to one another, which together may form a polygon such as an octagon.

More particularly, the shape of the surfaces of the inner profile/side 180 of first (collar) region of mounting members 176, 177 may engage, and mate with, the shape of the surface of the underlying outer profile of the barrel nut 163, while the shape of the surfaces of the outer profile/side 183 of first (collar) region of mounting members 176, 177 may engage, and mate with, the shape of the surfaces of the overlying inner profile 89 of the handguard 80.

As shown, for example, in order to engage and mate with the barrel nut 163 shown in FIG. 10, the inner profile/side 180 of first (collar) region 179 of mounting members 176, 177 may provide a cylindrical surface 181 which engages and mates with an underlying cylindrical surface 168 of cylindrical body portion 164 of barrel nut 163, as well as a leading (forward) conical surface 182 which engages and mates with an underlying conical rear surface 167 of scalloped lip/flange 165, including tines 166. Similarly, in order to engage, and mate with, the handguard 80 shown in FIG. 4, the outer profile/side 183 of first (collar) region of mounting members 176, 177 provide a plurality of planar surfaces 184 which together may form a polygon such as an octagon which engages and mates with octagonal profile 89 of tubular body 82 of handguard 80.

In addition to the foregoing, the mounting/attachment apparatus 174, and more particularly each of mounting members 176, 177, may include at least one threaded mounting aperture 186 (similar to aperture 153) in the first (collar) region 179 to receive mechanical (threaded) fastener 85 therein to retain and fasten the handguard 80 to the mounting/attachment apparatus 174 when assembled. The mounting aperture 186 may be a through-hole which extends completely through the first (collar) region 179, or a blind-hole which extends partially through the first (collar) region 179. In other embodiments, mounting aperture 186 may extend completely through the first (collar) region 179 and not be threaded. Mounting aperture 186 may then be aligned with a threaded aperture in the barrel nut 163 to receive the mechanical (threaded) fastener 85.

Continuing with FIGS. 12 and 13, the mounting/attachment apparatus 174, and more particularly each of mounting members 176, 177, may comprise a second, or tab, region 185 which projects longitudinally from first (collar) region 179 along the longitudinal axis 160. The second (tab) region 185 has a shape that corresponds to (or fits within) the scalloped regions 172 of the barrel nut 163. When the tab 185 of the mounting/attachment apparatus 174 engages at least one of the scalloped regions 172, the rotation of the mounting/attachment apparatus 174 about the longitudinal axis 170 of the barrel nut 163 is inhibited due to a positive mechanical interference. In such regard, second region 185 may be understood to provide a locking (anti-rotation) tab 185 which inhibits rotation of the mounting members 176, 177 relative to the barrel nut 163.

Referring now to FIGS. 14 and 15, mounting members 176, 177 of mounting/attachment apparatus 174 are shown seated (coupled) to the barrel nut 163. As shown, mounting members 176, 177 form a multi-piece (two-piece) collar 178 which at least partially circumscribes (encircles) and overlies the barrel nut 163. More particularly, the inner profile/side 180 of first (collar) region 179 of mounting members 176, 177 provides a cylindrical surface 181 which engages and mates with underlying cylindrical surface 168 of cylindrical body portion 164 of barrel nut 163, as well as a conical surface 182 which engages and mates with an underlying conical rear surface 167 of scalloped lip/flange 165, including tines 166. Also as shown, the first (collar) region 179 of the mounting/attachment apparatus 174 extends longitudinal to the longitudinal axis 170 of the barrel nut 163, and is substantially equal in longitudinal length to a longitudinal length of the cylindrical body portion 164 of barrel nut 163. In this manner, the conical surface 182 of mounting members 176, 177, as well as a leading (forward) end 190 of mounting members 176, 177, may engage (contact) at least one of the tines 166 of the barrel nut 163, while the trailing (rear) end 192 of mounting members 176, 177 may engage (contact) against upper receiver 16 to inhibit longitudinal (axial) movement of the of mounting members 176, 177. To prevent rotational movement around the longitudinal axis 170 of the barrel nut 163, the second (tab) region 185 of the mounting/attachment apparatus 174 engages in one of the scalloped regions 172.

In embodiments where the mounting/attachment apparatus 174 partially circumscribes the collar 178, the mounting/attachment apparatus 174 may be positioned and arranged to provide combustion gas return tube passageway 193, particularly between the mounting members 176, 177 to receive combustion gas return tube 42 (FIG. 4) therein and the combustion gas return tube 42 may be coupled to combustion gas return tube inlet 194. The passageway 193 is further aligned with at least one of the scalloped regions 172 of the barrel nut 163 such that the combustion gas return tube 42 may be received in one of the scalloped regions 172 as well as passageway 193. While the passageway 193 is shown as being located between separate mounting members 176, 177, the passageway 193 may also be formed by a notch formed in one or both of the mounting members 176, 177 and extending longitudinally along the complete length of the mounting members 176, 177. In embodiments where the passageway 193 is provided between mounting members 176, 177, the first mounting member 176 and the second mounting member 177 may circumscribe only those portions of the collar 178 where the gas return tube 42 does not pass.

As shown in FIG. 16, the handguard 80 slideably engages the outer profile/side 183 of the mounting/attachment apparatus 174. When the outer profile/side 183 of the mounting/attachment apparatus 174 takes a non-cylindrical (e.g. polygonal shape shown as an octagonal shape) which substantially conforms or matches to the inner profile 89 of the handguard 80, the handguard 80 is restrained from rotating about the longitudinal axis 170 of the barrel nut 163. As shown, in order for the handguard 80 to slideably engage with the mounting/attachment apparatus 174, the handguard 80 and the mounting/attachment apparatus 174 may both have a octagonal shape wherein the cross-sectional area enclosed by the handguard 80 is equal to or larger than the mounting/attachment apparatus 174, permitting the handguard 80 to slideably engage the mounting/attachment apparatus 174 while optionally forming an interference coupling. Alternatively, the cross-sectional area enclosed by the handguard 80 may be less than the mounting/attachment apparatus 174 to form an interference fit, however such may require additional force for the handguard to slideably engage with the mounting/attachment apparatus 174.

As shown in FIG. 17, when the handguard 80 fully engages the mounting/attachment apparatus 174, the mounting aperture 81 of the handguard 80 is substantially concentric with the threaded mounting aperture 186 of the mounting/attachment apparatus 174. As such, a mechanical (threaded) fastener 85 (e.g., bolt or screw) may be inserted through mounting aperture 81 of the handguard 80 and threadably engaged in the threaded mounting aperture 186 of the mounting/attachment apparatus 174, mechanically coupling the handguard 80 to the mounting/attachment apparatus 174. In some embodiments, the mounting aperture 81 of handguard 80 may be countersunk (or counter-bored) such that the mechanical (threaded) fastener 85 is substantially flush with the handguard 80 when fully engaged.

When the handguard 80 is coupled to the mounting/attachment apparatus 174 in the above manner, the handguard 80 is inhibited from rotating around the longitudinal axis LA and moving longitudinally along the longitudinal axis LA. As may be appreciated, rotational movement of the handguard 80 is inhibited by mechanically coupling/engaging handguard 80 to mounting members 176, 177 of mounting/attachment apparatus 174 via one or more threaded fasteners 85 and/or the shape of the outer profile/side 183 of the mounting/attachment apparatus 174 corresponding to the profile 89 of the handguard 80, and mechanically coupling/engaging one or more tab region 185 of mounting members 176, 177 of mounting/attachment apparatus 174 in scalloped regions 172 of the barrel nut 163. As also may be appreciated, forward longitudinal movement of the handguard 80 is inhibited by mechanically coupling/engaging handguard 80 to mounting members 176, 177 of mounting/attachment apparatus 174 via one or more threaded fasteners 85, and the collar region 179 of mounting members 176, 177 of mounting/attachment apparatus 174 being restrained against forward longitudinal movement by scalloped lip/flange 165 of barrel nut 163. As also may be appreciated, rearward longitudinal movement of the handguard 80 is inhibited by mechanically coupling/engaging handguard 80 to mounting members 176, 177 of mounting/attachment apparatus 174 via one or more threaded fasteners 85, and the collar region 179 of mounting members 176, 177 of mounting/attachment apparatus 174 being restrained against rearward longitudinal movement by receiver 16.

As shown by the drawings herein, to add stability to the mounting of the handguard 80 to the mounting/attachment apparatus 174, as well as the mounting/attachment apparatus 174 to the barrel nut 163, the collar 178 may be configured to overlie at least 50% of the surface area of the outer surface 168 of the cylindrical body portion 164 of the barrel nut 163, and more particularly, at least 60%, 70%, 80%, 80% or 85% of the surface area of the outer surface 168 of the cylindrical body portion 164 of the barrel nut 163.

Similarly, the collar 178 may be configured to overlie at least 50% of the overall longitudinal length of the cylindrical body portion 164 of the barrel nut 163, and more particularly, at least 60%, 70%, 80%, 90% or 95% of the overall longitudinal length of the cylindrical body portion 164 of the barrel nut 163.

Similarly, the collar 178 may be configured to overlie at least 50% of the overall circumferential length of the cylindrical body portion 164 of the barrel nut 163, and more particularly at least 60%, 70%, 80% or 85% of the overall circumferential length (circumference) of the cylindrical body portion 164 of the barrel nut 163. In order to provide combustion gas return tube passageway 193 to accommodate combustion gas return tube 42, the collar 178 may be configured to overlie less than the overall circumferential length of the cylindrical body portion 164 of the barrel nut 163, and more particularly less than 90-95% of the overall circumferential length (circumference) of the cylindrical body portion 164 of the barrel nut 163, with the remaining 5-10% (of greater) of the circumferential length the cylindrical body portion 164 of the barrel nut 163 being used to provide combustion gas return tube passageway 193 to accommodate combustion gas return tube 42. Thus, the collar 178 may be configured to overlie 50% to 95% of the overall circumferential length of the cylindrical body portion 164 of the barrel nut 163, or any other combination of percentages above (e.g. 50%-90%, 60%-95%, 60%-90%, etc.)

As the longitudinal length and the circumferential length of the collar 178 increase, and the corresponding surface area, such may provide the mounting/attachment apparatus 174 with greater stability for mounting and attaching the handguard 80.

Referring now to FIG. 18, there is shown another embodiment of a handguard mounting/attachment apparatus according to the present disclosure, which may comprise first and second mounting members 176, 177 having an outer profile/side 183 which has an arcuate surface 184. As shown, the arcuate surface 184 of each outer profile/side 183 of each of first and second mounting members 176, 177 may be semi-cylindrical, and more particularly formed by an arc of constant radius over a range of 120 to 170 degrees.

While embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

LISTING OF REFERENCE CHARACTERS

10 firearm
12 receiver
14 lower receiver
16 upper receiver
18 magazine receptacle
30 bolt carrier
40 barrel
42 combustion gas return tube
50 butt stock
60 pistol grip
80 handguard
81 mounting aperture
82 tubular body
83 wall of tubular body
84 center passage
85 mechanical (threaded) fastener
86 tubular body outer surface
88 tubular body inner surface
89 inner profile
90 apertures
92 top side of handguard
94 accessory rail
96 rail ribs
98 rail slots
100 rail reinforcement structure
102 reinforcement layer
104 reinforcement layer
106 reinforcement layer
108 reinforcement layer
110 matrix composition
120 lower elongated rail segment
122 planar upper surface
130 upper elongated rail segment
132 planar lower surface
140 inner elongated rail segment
146 mounting/attachment apparatus
150 longitudinal passage
151 tubular mounting member
152 outer profile of mounting/attachment apparatus
153 mounting aperture of mounting/attachment apparatus
154 ribs of mounting/attachment apparatus
156 inner profile of mounting/attachment apparatus
158 grooves of mounting/attachment apparatus
160 longitudinal axis of mounting/attachment apparatus
162 raceway of mounting/attachment apparatus
163 barrel nut
164 main (cylindrical) body portion of barrel nut
165 flange/lip of barrel nut
166 tines of barrel nut
167 outer conical surface of barrel nut
168 outer cylindrical surface of barrel nut
170 longitudinal axis of barrel nut
172 scalloped regions of barrel nut
174 mounting/attachment apparatus
176 first mounting member
177 second mounting member
178 collar
179 first (collar) region of mounting/attachment apparatus
180 inner profile/side of mounting/attachment apparatus
181 surface of inner profile/side of first (collar) region
182 conical surface of inner profile/side of first (collar) region
183 outer profile/side of mounting/attachment apparatus
184 surface of outer profile/side of first (collar) region
185 second (tab) region of mounting/attachment apparatus
186 mounting aperture of mounting/attachment apparatus
190 leading (forward) end of mounting/attachment apparatus
192 trailing (rear) end of mounting/attachment apparatus
193 passageway
194 combustion gas return tube inlet
LA longitudinal axis

What is claimed is:

1. An apparatus to couple a handguard to a firearm having a receiver and a barrel nut rotatably couplable to the receiver, wherein the barrel nut includes a cylindrical portion and an outwardly protruding flange with a plurality of scalloped regions, the apparatus comprising:

at least one handguard mounting member, wherein the at least one handguard mounting member comprises a first handguard mounting member couplable to the barrel nut and a second handguard mounting member couplable to the barrel nut, the first and the second handguard mounting members providing a collar configured to at least partially circumscribe the cylindrical portion of the barrel nut, wherein the first and the second handguard mounting members are separate components from each other and from the handguard whereby the handguard is installable by movement of the handguard relative to the first and the second handguard mounting members;

wherein the at least one handguard mounting member comprises at least one tab configured to fit in at least one scalloped region of the plurality of scalloped regions of the protruding flange of the barrel nut to inhibit rotation of at least one of the handguard mounting members relative to the barrel nut;

wherein the at least one tab configured to fit in at least one scalloped region of the plurality of scalloped regions further comprises at least two tabs, each tab configured to fit in a respective one of the plurality of scalloped regions;

wherein a first tab of the at least two tabs is provided by the first handguard mounting member, wherein the first tab is a cantilevered first tab;

wherein a second tab of the at least two tabs is provided by the second handguard mounting member, wherein the second tab is a cantilevered second tab; and wherein, when the first handguard mounting member and the second handguard mounting member are coupled to the barrel nut and the barrel nut is rotatably coupled to the receiver, the first handguard mounting member and the second handguard mounting member are rotatable with the barrel nut relative to the receiver.

2. The apparatus of claim 1 wherein:

the at least two tabs configured to fit in a respective one of the plurality of scalloped regions further comprises at least four tabs, each tab configured to fit within a respective one of the plurality of scalloped regions;

a first two tabs of the at least four tabs provided by the first handguard mounting member; and a second two tabs of the at least four tabs provided by the second handguard mounting member.

3. The apparatus of claim 1 wherein:

the cylindrical portion of the barrel nut has an outer surface with a surface area; and the collar is configured to overlie at least 50% of the surface area of the outer surface of the cylindrical portion of the barrel nut.

4. The apparatus of claim 1 wherein:

the cylindrical portion of the barrel nut has an overall longitudinal length; and the collar is configured to overlie at least 50% of the overall longitudinal length of the cylindrical portion of the barrel nut.

5. The apparatus of claim 1 wherein:

the cylindrical portion of the barrel nut has an overall circumferential length; and the collar is configured to overlie at least 50% of the overall circumferential length of the cylindrical portion of the barrel nut.

6. The apparatus of claim 1 wherein:

the collar of the handguard mounting members has an inner side; and the inner side includes an arcuate surface configured to mate with the cylindrical portion of the barrel nut.

7. The apparatus of claim 1 wherein:

the collar of the handguard mounting members has an outer side; and the outer side includes at least one planar surface configured to mate with a planar surface of the handguard.

8. The apparatus of claim 1 wherein:

the collar of the handguard mounting members has an outer side; and the outer side includes a plurality of planar surfaces configured to respectively mate with a plurality of planar surfaces of the handguard.

9. The apparatus of claim 1 wherein:

the collar of the handguard mounting members has an outer side; and the outer side includes at least one arcuate surface configured to mate with an arcuate surface of the handguard.

10. The apparatus of claim 1 wherein:

each of the first and the second handguard mounting members is configured to receive a first and a second mechanical fastener, respectively, to mechanically couple to the handguard.

11. The apparatus of claim 10 wherein:

each of the first and the second handguard mounting members includes at least one mounting aperture configured to receive the first and the second mechanical fastener, respectively.

12. The apparatus of claim 11 wherein:

the at least one mounting aperture of each of the first and the second handguard mounting members is a threaded aperture.

13. The apparatus of claim 1 wherein:

the collar provides a gap between the first and the second handguard mounting members, the gap providing a gas return tube passageway which extends longitudinally along a longitudinal axis of the collar.

14. The apparatus of claim 13 wherein:

the collar is coupleable to the barrel nut such that the gas return tube passageway aligns longitudinally with at least one scalloped region of the plurality of scalloped regions of the barrel nut.

15. The apparatus of claim 1 wherein:

the at least one handguard mounting member only occupies a portion of the plurality of scalloped regions of the protruding flange of the barrel nut.

16. A firearm comprising:

a receiver;

a handguard;

a barrel nut rotatably couplable to the receiver, wherein the barrel nut includes a cylindrical portion and an outwardly protruding flange with a plurality of scalloped regions;

an apparatus to couple the handguard to the barrel nut, the apparatus including at least one handguard mounting member, wherein the at least one handguard mounting member comprises a first handguard mounting member couplable to the barrel nut and a second handguard mounting member couplable to the barrel nut, the first and the second handguard mounting members providing a collar configured to at least partially circumscribe the cylindrical portion of the barrel nut, wherein the first and the second handguard mounting members are separate components from each other and from the handguard whereby the handguard is installable by movement of the handguard relative to the first and the second handguard mounting members;

wherein the at least one handguard mounting member comprises at least one tab configured to fit in at least one scalloped region of the plurality of scalloped regions of the protruding flange of the barrel nut to inhibit rotation of at least one of the handguard mounting members relative to the barrel nut;

wherein the at least one tab configured to fit in at least one scalloped region of the plurality of scalloped regions further comprises at least two tabs, each tab configured to fit in a respective one of the plurality of scalloped regions;

wherein a first tab of the at least two tabs is provided by the first handguard mounting member, wherein the first tab is a cantilevered first tab;

wherein a second tab of the at least two tabs is provided by the second handguard mounting member, wherein the second tab is a cantilevered second tab; and wherein, when the first handguard mounting member and the second handguard mounting member are coupled to the barrel nut and the barrel nut is rotatably coupled to the receiver, the first handguard mounting member and the second handguard mounting member are rotatable with the barrel nut relative to the receiver.

17. The firearm of claim 16 wherein:

the firearm is a rifle.

18. The firearm of claim 16 wherein:

the handguard comprises a tubular body, the tubular body comprising one continuous piece disposed 360 degrees around a longitudinal axis of the firearm; and the handguard is installable by sliding the handguard along the longitudinal axis over the first and the second handguard mounting members.

* * * * *